US011644223B2

(12) United States Patent
Su et al.

(10) Patent No.: US 11,644,223 B2
(45) Date of Patent: May 9, 2023

(54) FALLING FILM EVAPORATOR

(71) Applicants: York (Wuxi) Air Conditioning and Refrigeration Co., Ltd., Wuxi (CN); Johnson Controls Tyco IP Holdings LLP, Milwaukee, WI (US)

(72) Inventors: Xiuping Su, Wuxi (CN); Shenglong Wang, Wuxi (CN); Shimin Sheng, Wuxi (CN); Minnan Fan, Wuxi (CN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/268,385

(22) PCT Filed: Aug. 13, 2019

(86) PCT No.: PCT/CN2019/100330
§ 371 (c)(1),
(2) Date: Feb. 12, 2021

(87) PCT Pub. No.: WO2020/034937
PCT Pub. Date: Feb. 20, 2020

(65) Prior Publication Data

US 2021/0318040 A1 Oct. 14, 2021

(30) Foreign Application Priority Data

Aug. 14, 2018 (CN) ..... 201810923286.9
Aug. 14, 2018 (CN) ..... 201821312966.9

(51) Int. Cl.
*F25B 39/02* (2006.01)

(52) U.S. Cl.
CPC .... *F25B 39/028* (2013.01); *F25B 2339/0242* (2013.01)

(58) Field of Classification Search
CPC ..... F25B 39/028; F25B 2339/0242; F25B 2339/024; F25B 39/02; F28D 3/04;
(Continued)

(56) References Cited

U.S. PATENT DOCUMENTS 5,588,596 A * 12/1996 Hartfield ..... B01D 1/04 239/557
2010/0242533 A1* 9/2010 De Larminat ..... F25B 41/20 62/515
2013/0277019 A1* 10/2013 Numata ..... F25B 39/02 165/157

FOREIGN PATENT DOCUMENTS

CN 1185202 A 6/1998
CN 102472589 A 5/2012
(Continued)

OTHER PUBLICATIONS

PCT International Search Report for PCT Application No. PCT/CN2019/100330 dated Nov. 13, 2019, 5 pgs.
(Continued)

*Primary Examiner* — Harry E Arant
(74) *Attorney, Agent, or Firm* — Fletcher Yoder, P.C.

(57) ABSTRACT

A falling film evaporator (100), a housing (101) thereof being accommodated with a heat exchange tube (304), a perforated plate (205) and a spraying tube (202), the perforated plate (205) being provided between the spraying tube (202) and the heat exchange tube (304), such that refrigerant sprayed from the spraying tube (202) is sprayed onto the surface of the heat exchange tube (304) by means of distribution of the perforated plate (205); spraying openings (301) on the spraying tube (202) have a strip shape, and the extension direction of the openings is perpendicular to the length direction of the spraying tube (202). By means of configuring the length direction of the spraying tube (202) to be substantially perpendicular to the length direction of the heat exchange tube (304), refrigerant sprayed from the spraying openings (301) flows substantially in the length direction of the housing (101), the flow path of the refrigerant being lengthened, avoiding uneven spraying on the surface of the heat exchange tube (304).

14 Claims, 8 Drawing Sheets

(58) Field of Classification Search
CPC ..... F28D 7/16; F28D 5/02; F28D 2021/0071; F28F 9/005; F28F 1/006; F28F 1/02; F28F 1/022; F28F 1/025
See application file for complete search history.

(56) References Cited

FOREIGN PATENT DOCUMENTS

| | | | | |
|---|---|---|---|---|
| CN | 102914097 | A | | 2/2013 |
| CN | 103851836 | A | * | 6/2014 |
| CN | 103851836 | A | | 6/2014 |
| CN | 104303000 | A | | 1/2015 |
| CN | 104307192 | A | | 1/2015 |
| CN | 204170439 | U | | 2/2015 |
| CN | 105783347 | A | * | 7/2016 |
| CN | 105783347 | A | | 7/2016 |
| CN | 107866087 | A | | 4/2018 |
| JP | 2000230760 | A | | 8/2000 |
| JP | 2014020724 | A | | 2/2014 |
| WO | 2013074749 | A1 | | 5/2013 |

OTHER PUBLICATIONS

European Search Report for EP Application No. 19849342.1, dated Mar. 21, 2022, 6 pgs.

* cited by examiner

FALLING FILM EVAPORATOR

CROSS-REFERENCE TO RELATED APPLICATIONS

This application is a U.S. National Stage Application of PCT Application No. PCT/CN2019/100330, entitled "FALLING FILM EVAPORATOR," filed Aug. 13, 2019, which claims priority to and the benefit of Chinese Patent Application No. 201810923286.9, filed Aug. 14, 2018, and Chinese Utility Model Application No. 201821312966.9, filed Aug. 14, 2018, each of which is herein incorporated by reference in its entirety for all purposes.

TECHNICAL FIELD

The present application relates to the technical field of falling film evaporators.

BACKGROUND ART

Falling film evaporators generally use a refrigerant distributor to distribute a refrigerant to the surfaces of heat exchange tubes in a heat exchange tube bundle, so as to form a liquid film for evaporation; they exploit the mechanism of thin-film evaporation from heat exchange tube surfaces, have the advantages of high heat transfer efficiency and small refrigerant charge, and have been a focus of research in the refrigeration and air conditioning industries in recent years. However, the uniformity of distribution of refrigerant on the heat exchange tube bundle in the evaporator is a key factor limiting the evaporator's heat exchange performance. The state of refrigerant entering the refrigerant distributor is generally gas and liquid phases; if the two phases of refrigerant are not uniformly distributed onto the heat exchange tube bundle of the falling film evaporator, the result will be that the refrigerant distributor supplies too much refrigerant to a portion of the heat exchange tubes and too little refrigerant to another portion of the heat exchange tubes, and the phenomenon of "dry spots" will occur, leading to a drop in the overall heat exchange performance of the falling film evaporator.

SUMMARY OF THE INVENTION

An object of the present application is to provide an improved falling film evaporator, capable of distributing a refrigerant uniformly to heat exchange tubes.

To achieve the above object, the present application provides a falling film evaporator, comprising: a housing, a heat exchange tube, a perforated plate, a spray tube and a liquid entry tube. The housing has an accommodating cavity; the length direction of the heat exchange tube is the same as the length direction of the housing; the perforated plate is arranged above the heat exchange tube, and the perforated plate is provided with multiple distribution holes; the spray tube is arranged above the perforated plate, the spray tube having multiple spray ports, the spray ports being distributed at intervals in the length direction of the spray tube, and the spray ports being configured to be capable of spraying a refrigerant toward the perforated plate; and the liquid entry tube is in fluid communication with the spray tube, such that the refrigerant flowing through the liquid entry tube can flow into the spray tube; wherein the heat exchange tube, the perforated plate and the spray tube are all arranged in the accommodating cavity; and the length direction of the spray tube is substantially perpendicular to the length direction of the housing.

In the falling film evaporator described above, the length direction of the perforated plate is the same as the length direction of the housing, and the spray port is configured such that after the refrigerant has been sprayed toward the perforated plate, the refrigerant can flow in the length direction of the perforated plate.

In the falling film evaporator described above, the bottom of the spray tube has a circular-arc end face, the circular-arc end face protruding in the direction of the perforated plate, the spray port is in the form of a strip, and at least a part of the spray port is arranged on the circular-arc end face.

In the falling film evaporator described above, the spray tube has two extension parts extending in the length direction of the housing, an end of the extension part comprises an outwardly protruding circular-arc end face, the spray port is in the form of a strip, and at least a part of the spray port is arranged on the circular-arc end face.

In the falling film evaporator described above, a cross section of the spray tube has a flattened oval shape, the two extension parts are located at left and right ends of the spray tube respectively, the spray port is in the form of a strip, and the spray port extends toward the circular-arc end faces at the left and right ends of the spray tube respectively from the bottom of the spray tube.

In the falling film evaporator described above, a cross section of the spray tube has an inverted-"Y" shape, the two extension parts are separately located at the bottom of the spray tube and extend obliquely downward, the spray port is in the form of a strip, and at least a part of the spray port is arranged on the circular-arc end face.

In the falling film evaporator described above, multiple said spray tubes are arranged in the falling film evaporator, and top ends of the multiple spray tubes are in communication with each other, so that the multiple spray tubes are in fluid communication with each other.

In the falling film evaporator described above, the number of the spray tubes is an even number, and the multiple spray tubes are distributed symmetrically relative to the liquid entry tube.

The falling film evaporator described above further comprises a liquid entry box, the liquid entry box being arranged between the liquid entry tube and the spray tube, such that the liquid entry tube and the spray tube can be in fluid communication with each other by means of the liquid entry box.

The falling film evaporator described above further comprises a cover plate, the cover plate being arranged at an upper part of the spray tube, and two side edges of the cover plate extend toward the perforated plate and are directly or indirectly connected to two side edges of the perforated plate in a sealed fashion.

In the falling film evaporator of the present application, the length direction of the spray tube is configured to be substantially perpendicular to the length direction of the evaporator housing; this configuration enables refrigerant sprayed out of the spray ports to move substantially in the length direction of the housing, thus extending the flow path of the refrigerant sprayed out of the spray ports, and avoiding the problem of sprayed refrigerant being sprayed unevenly over the surface of the heat exchange tube due to the flow thereof being hindered.

DETAILED DESCRIPTION OF THE INVENTION

Various specific embodiments of the present application will be described below with reference to the drawings which form a part of this Specification. It should be understood that although terms indicating direction such as "front", "rear", "upper", "lower", "left", "right", "top", "bottom", etc. are used in the present application to describe various demonstrative structural parts and elements of the present application, these terms are used herein for convenience of description only, determined on the basis of the demonstrative orientations shown in the figures. Since the embodiments disclosed herein may be arranged in different orientations, these terms indicating direction are merely illustrative and should not be regarded as limiting.

Figure 1:
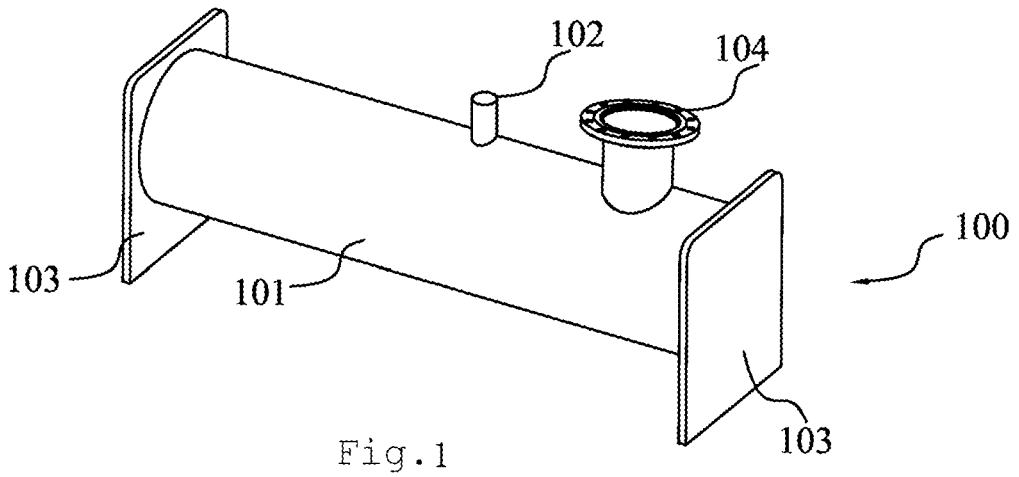
FIG. 1 is a schematic diagram of the three-dimensional structure of a falling film evaporator 100 in an embodiment of the present application.

FIG. 1 shows a three-dimensional structure of a falling film evaporator 100 in an embodiment of the present application. As shown in FIG. 1, the falling film evaporator 100 comprises a housing 101, a liquid entry tube 102, a gas suction tube 104 and tube plates 103. The housing 101 is substantially cylindrical, and the tube plates 103 are arranged at two ends in the length direction of the housing 101 respectively. The liquid entry tube 102 is arranged at an upper part of the housing 101, and configured to guide refrigerant into the interior of the housing 101. The gas suction tube 104 is also arranged at an upper part of the housing 101, and configured to discharge gaseous refrigerant from the housing 101.

Figure 2:
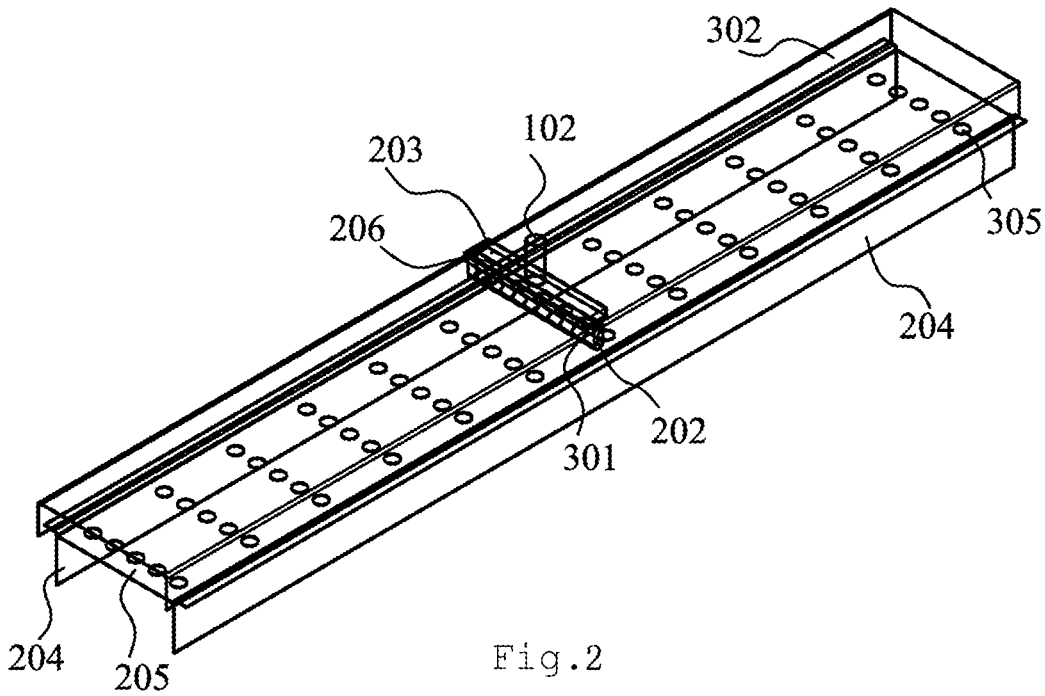
FIG. 2 is a structural schematic diagram of some of the components located inside a housing 101 of the falling film evaporator 100 shown in FIG. 1.

FIG. 2 is a structural schematic diagram of some of the components located inside the housing 101 of the falling film evaporator 100 shown in FIG. 1, wherein for convenience of illustration, the liquid entry tube 102 located outside the housing 101 is retained in FIG. 2. As shown in FIG. 2, the falling film evaporator 100 further comprises a spray tube 202, a perforated plate 205 and a heat exchange tube bundle 201 which are arranged in an accommodating cavity of the housing 101 (shown in FIG. 3). The spray tube 202 is arranged below the liquid entry tube 102, the perforated plate 205 is arranged below the spray tube 202, and the heat exchange tube bundle 201 is arranged below the perforated plate 205. The spray tube 202 is substantially in the form of a tube with two ends closed. An inlet 206, configured to be in fluid communication with the liquid entry tube 102, is provided at the top of the spray tube 202. Multiple spray ports 301 are provided at the bottom of the spray tube 202, and are configured to spray refrigerant, which has entered the spray tube 202, onto the perforated plate 205 below the spray tube 202. The perforated plate 205 is substantially in the form of a long strip, and the length direction thereof is the same as the length direction of the housing 101. The perforated plate 205 is provided with multiple distribution holes 305, which are configured to redistribute refrigerant sprayed onto the perforated plate 205, so that the refrigerant can be uniformly distributed onto the heat exchange tube bundle 201 below the perforated plate 205. Side stop plates 204 are also provided at left and right opposite sides of the perforated plate 205; the two side stop plates 204 extend downward perpendicular to the perforated plate 205, such that the two side stop plates 204 and the perforated plate 205 together form an accommodating space that opens downward. In the embodiment shown in FIG. 2, all of the distribution holes 305 in the perforated plate 205 are round. In other embodiments, the distribution holes 305 may also be of another shape, e.g. oval, square or rhombus, etc. Moreover, the length direction of the spray tube 202 is substantially perpendicular to the length direction of the perforated plate 205. That is to say, the length direction of the spray tube 202 is the same as the width direction of the perforated plate 205. Generally, the length direction of the spray tube 202 is perpendicular to the length direction of the perforated plate 205, but deviation in the positional relationship of the two components within a certain range is not restricted. The spray tube 202 is arranged in a middle position in the length direction of the perforated plate 205, so that refrigerant sprayed out from the spray tube 202 can be uniformly sprayed from the middle position in the length direction of the perforated plate 205 to two sides in the length direction of the perforated plate 205.

The falling film evaporator 100 further comprises a liquid entry box 203 arranged between the spray tube 202 and the liquid entry tube 102, and a cover plate 302 arranged at an upper part of the spray tube 202. The liquid entry box 203 extends in the length direction of the spray tube 202, and is configured to establish fluid communication between the liquid entry tube 102 and the inlet 206 of the spray tube 202, in order to enable preliminary distribution of refrigerant in the length direction of the spray tube 202. The cover plate 302 extends in the length direction of the perforated plate 205, and two side edges of the cover plate 302 extend downward, such that the cover plate 302 appears as an inverted-"U"-shaped structure. The cover plate 302 is located between the liquid entry box 203 and the spray tube 202, and is provided with an opening between the liquid entry box 203 and the spray tube 202, so as to ensure communication between the liquid entry box 203 and the spray tube 202. The spray ports 301 on the spray tube 202 are located in a cavity between the cover plate 302 and the perforated plate 205, thereby ensuring that refrigerant sprayed out of the spray ports 301 can be guided by the cover plate 302 so as to flow toward the perforated plate 205.

Figure 3:
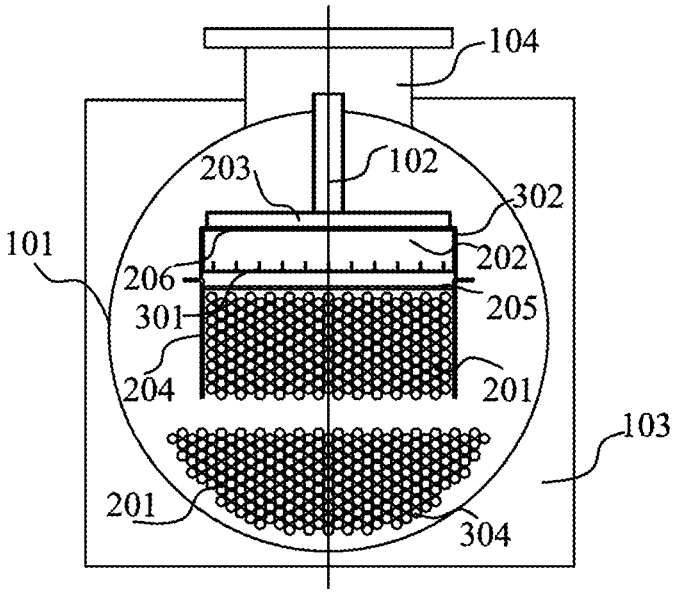
FIG. 3 is a radial sectional view, at the position of a liquid entry tube 102, of the falling film evaporator 100 shown in FIG. 1.

FIG. 3 is a radial sectional view, at the position of the liquid entry tube 102, of the falling film evaporator 100 shown in FIG. 1. As shown in FIG. 3, the housing 101 contains two heat exchange tube bundles 201, wherein one heat exchange tube bundle 201 is arranged in the accommodating space formed by the perforated plate 205 and the two side stop plates 204, and the other heat exchange tube bundle 201 is arranged at the bottom of the accommodating cavity of the housing 101, each heat exchange tube bundle 201 comprising multiple heat exchange tubes 304.

Figure 4:
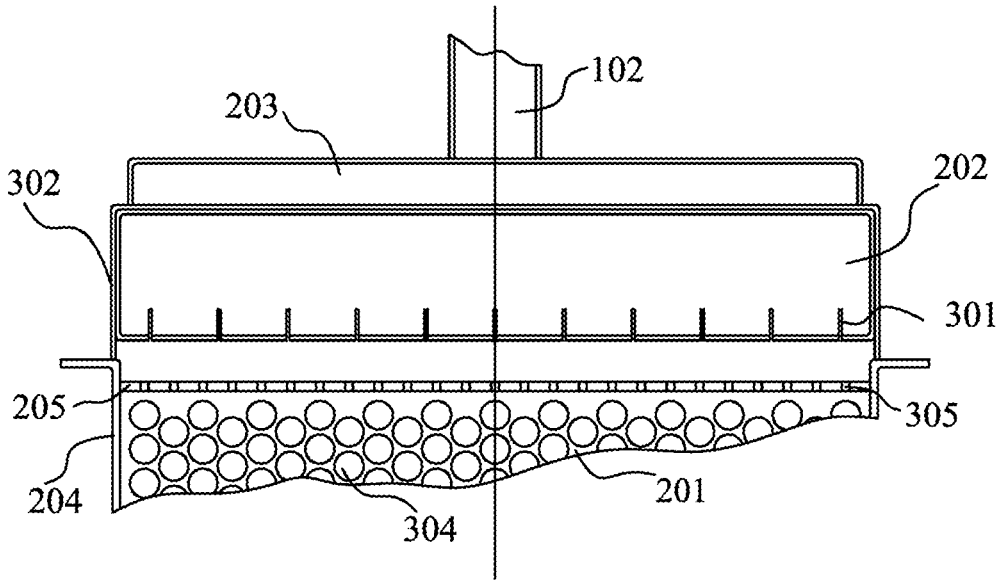
FIG. 4 is a partial enlarged drawing, in a region of a spray tube 202, of the falling film evaporator 100 shown in FIG. 3.

FIG. 4 is a partial enlarged drawing, in a region of the spray tube 202, of the falling film evaporator 100 shown in FIG. 3. As shown in FIG. 4, the multiple spray ports 301 are arranged at the bottom of the spray tube 202, spaced apart in the length direction of the spray tube 202. The cover plate 302 is connected to the side stop plates 204 in a sealed fashion, so as to ensure that all of the refrigerant sprayed out of the spray ports 301 flows toward the perforated plate 205, and is distributed, via the distribution holes 305 in the perforated plate, onto the heat exchange tube bundle 201 to undergo heat exchange. In other embodiments, the cover plate 302 may also be directly connected in a sealed fashion to two side edges in the width direction of the perforated plate 205; such a configuration can likewise ensure that all of the refrigerant sprayed out of the spray ports 301 flows toward the perforated plate 205.

Figure 5:
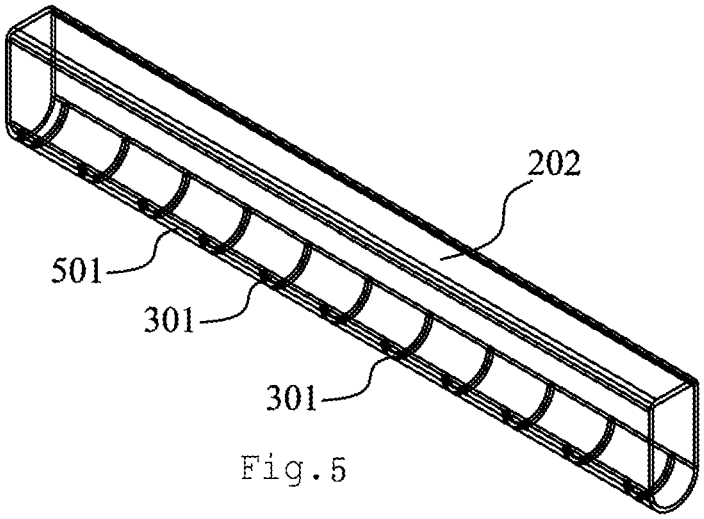
FIG. 5 is a schematic diagram of the three-dimensional structure of the spray tube 202 in FIG. 2.

FIG. 5 shows the three-dimensional structure of the spray tube 202 shown in FIG. 2. As shown in FIG. 5, the multiple spray ports 301 are provided at the bottom of the spray tube 202. Each spray port 301 is in the form of a strip, and extends from the bottom of the spray tube 202 toward two side walls; due to the direction of extension of the openings of the spray ports 301, the plane in which each spray port 301 lies is perpendicular to the length direction of the spray tube 202. The multiple spray ports 301 are parallel to each other and arranged spaced apart in the length direction of the spray tube 202.

Figure 6:
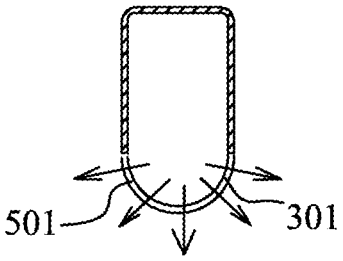
FIG. 6 shows a cross section, at the position of a spray port 301, of the spray tube 202 shown in FIG. 5.

FIG. 6 shows a cross section, at the position of the spray port 301, of the spray tube 202 shown in FIG. 5. As shown in FIG. 6, an upper part of the cross section of the spray tube 202 is substantially rectangular, while a lower part is substantially a semicircular arc; the spray port 301 is located at the position of the semicircular arc at the bottom of the spray tube 202, as shown by the blank part at the lower part of the spray tube in FIG. 6. When refrigerant is sprayed out of the spray port 301 of the spray tube 202, the refrigerant is spread outward uniformly in the opening direction of the spray port 301. It can be seen from FIG. 5 that the refrigerant sprayed out of the spray ports 301 has a certain flow speed, and due to the fact that the spray ports 301 take the form of long, narrow strips, there is almost no spreading of the sprayed refrigerant in the length direction of the spray tube 202; most of the refrigerant is sprayed out only in the width direction of the spray tube 202.

Figure 7:
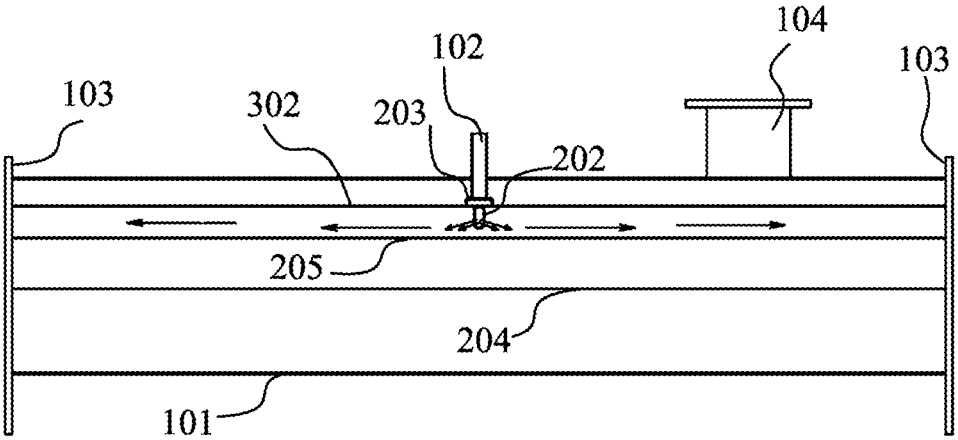
FIG. 7 shows movement paths of refrigerant after being sprayed out of the spray tube 202 with the positional arrangement shown in FIG. 4.

FIG. 7 shows an axial sectional view, at the position of the liquid entry tube 102, of the housing 101 of the falling film evaporator 100, wherein the arrows indicate the movement paths of refrigerant after being sprayed out of the spray tube 202. As shown in FIG. 7, the cover plate 302, perforated plate 205 and side stop plates 204 have the same length direction as the housing 101, and are all of substantially the same length, with all of the ends thereof extending to the tube plates 103. Influenced by the shape of the openings of the spray ports 301 and the pressure difference between the inside and outside of the spray tube 202, the refrigerant sprayed out of the spray tube 202 is sprayed into a region below the spray ports 301 until it reaches the perforated plate 205. Since the refrigerant has a high initial speed when sprayed out of the spray ports 301, the refrigerant still retains a high speed after being sprayed to the perforated plate 205, thus the refrigerant will flow toward the two ends of the perforated plate 205 in the length direction of the perforated plate 205. The perforated plate 205 is of adequate length, so the speed of the refrigerant will fall as it flows continuously, and when the refrigerant has moved to positions close to the tube plates 103 at the two sides, the speed of the refrigerant is already very low, so eddies will not form at the tube plates 103 at the two sides, and uniform distribution of refrigerant over the surface of the perforated plate is thereby achieved. As the refrigerant moves in the length direction of the perforated plate 205, the refrigerant can flow from the distribution holes 305 in the perforated plate 205 toward the heat exchange tube bundle 201 below the perforated plate 205, such that the refrigerant is uniformly distributed onto the multiple heat exchange tubes 304 in the heat exchange tube bundle 201.

Figure 8A:
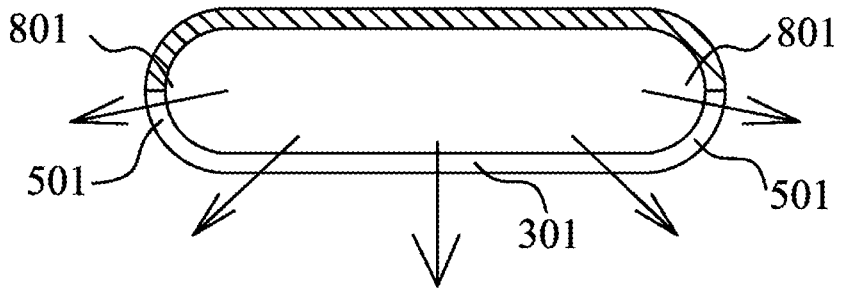
FIG. 8A shows a first embodiment of the cross-sectional shape, at the position of the spray port 301, of the spray tube 202.
Figure 8B:
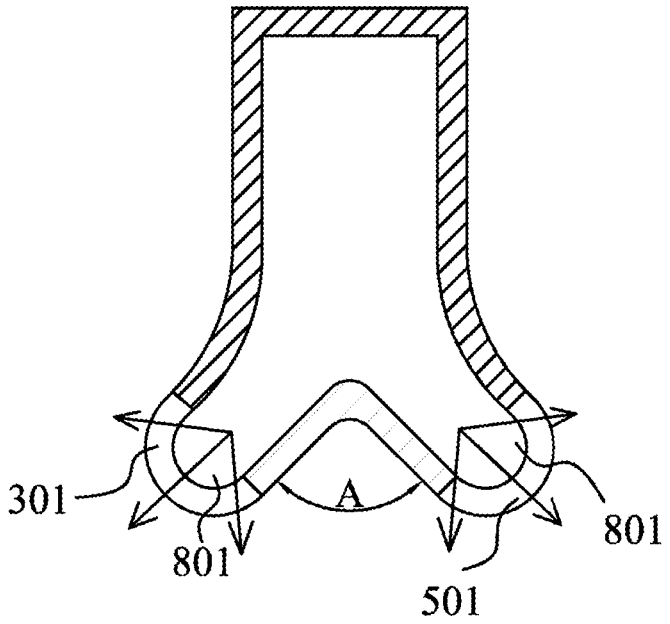
FIG. 8B shows a second embodiment of the cross-sectional shape, at the position of the spray port 301, of the spray tube 202.

FIGS. 8A and 8B show cross sections, at the position of the spray port, of two other embodiments of the spray tube 202 respectively. In these two embodiments, the cross-sectional shape of the spray tube 202 is different from the cross-sectional shape of the spray tube 202 shown in FIG. 6. The cross section of the spray tube 202 shown in FIG. 6 is longer in the vertical direction overall, with a narrower transverse width; the specific manifestation of this is that the upper part is rectangular while the lower part is a semicircular arc. However, when the transverse width of the cross section of the spray tube 202 is narrower, the movement distance of refrigerant in the length direction of the perforated plate 205 will be restricted; thus, in order to enable the refrigerant sprayed out of the spray tube 202 to move to positions close to the tube plates 103 successfully, in some embodiments of the present application, the spray tube 202 is extended in the width direction of the spray tube 202 (i.e. the length direction of the housing 101) to form two extension parts 801, and the spray ports are at least partially arranged on the extension parts, thus helping to increase the spraying distance of refrigerant in the length direction of the housing 101.

As shown in FIG. 8A, the cross section of the spray tube 202 has a flattened oval shape, with flat and straight edges at upper and lower sides, the two extension parts 801 being located at left and right sides of the spray tube 202 respectively, and an end of each extension part 801 having an outwardly protruding circular-arc end face 501; due to the structure just described, the cross section of the spray tube 202 has a longer transverse span. FIG. 8A shows the position of the spray port 301 at the blank part of the cross section of the spray tube; the spray port 301 is in the form of a strip, located in the lower half of the spray tube 202, and extends from the bottom of the spray tube 202 toward the circular-arc end faces 501 at the two sides.

The cross section of the spray tube 202 shown in FIG. 8B has an inverted-"Y" shape; the two extension parts 801 are arranged at two sides at the bottom of the spray tube 202 respectively and extend obliquely downward, such that a certain angle A is formed between the two extension parts 801. In some embodiments, the angle A is greater than or equal to 60°, so that the transverse width of the spray tube 202 is extended to a greater extent. It can be seen from FIG. 8B that an end of each extension part 801 has an outwardly protruding circular-arc end face 501, with spray ports 301 being substantially located on the two circular-arc end faces 501. FIG. 8B shows two spray ports 301 located on the same cross section of the spray tube 202. In the length direction of the spray tube 202, a row of spray ports 301 is arranged spaced apart on the circular-arc end face 501 at each side; thus, two rows of spray ports 301 are arranged on the single spray tube 202 shown in FIG. 8B, greatly increasing the spraying distance of refrigerant in the length direction of the perforated plate 205.

Figure 9:
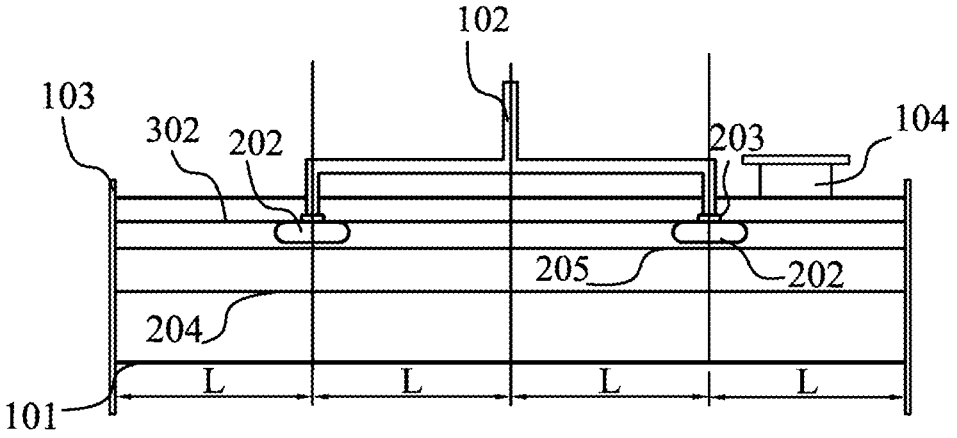
FIG. 9 is an axial sectional view, at the position of the liquid entry tube 102, of a falling film evaporator having two spray tubes 202.

FIG. 9 is an axial sectional view, at the position of the liquid entry tube 102, of a falling film evaporator having two spray tubes 202. As shown in FIG. 9, in order to adapt to a longer length of the housing 101, and increase the spraying distance of the spray tube 202 in the length direction of the housing 101, the embodiment shown in FIG. 9 uses two spray tubes 202 arranged side by side in the interior of the evaporator housing 101. The cross sections of the spray tubes 202 may be any of the shapes in FIGS. 6, 8A and 8B, and one liquid entry box 203 is provided above each spray tube 202, such that refrigerant can undergo preliminary distribution in the length direction of the spray tube 202 before entering the spray tube 202. To facilitate uniform distribution of refrigerant, the liquid entry tube 102 is arranged in a middle position in the axial direction of the housing 101, and the two spray tubes 202 are arranged in parallel at the same height above the perforated plate 205, and arranged symmetrically at left and right sides of the liquid entry tube 102. As shown in FIG. 9, the gap between a center axis of either one of the two spray tubes 202 in the vertical direction and a center axis of the liquid entry tube 102 is L, and the distance between the center axis of either one of the two spray tubes 202 in the vertical direction and the tube plate 103 at the side corresponding thereto is also L. The symmetric structural arrangement of the spray tube 202 that has just been described helps to spray refrigerant to the surface of the perforated plate 205 uniformly.

To achieve the abovementioned arrangement of the spray tubes 202, the liquid entry tube 102 in the embodiment shown in FIG. 9 is arranged as follows: one end, close to a refrigerant inlet, of the liquid entry tube 102 is extended vertically; before extending into the housing 101, the liquid entry tube 102 is bifurcated into two branch tubes, which extend horizontally toward two sides in the length direction of the housing 101 respectively; above the positions of the two spray tubes 202, the two branch tubes are each formed into perpendicular corners and thereby extend vertically downward, until they enter the interior of the housing 101, so as to be respectively connected to the two liquid entry boxes 203 arranged above the two spray tubes 202. By means of the arrangement just described, refrigerant is bifurcated into two paths after entering the liquid entry tube 102, and flows into the two different spray tubes 202 respectively.

In some embodiments, the number of spray tubes 202 may be set to be an even number greater than two, in order to adapt to a falling film evaporator having a housing of greater length. Setting the number of spray tubes 202 to be an even number facilitates the uniform distribution thereof at the two sides of the liquid entry tube 102, so that the refrigerant flowing through the liquid entry tube 102 is uniformly distributed to the spray tubes 202.

FIGS. 10A-10D show other embodiments in which two spray tubes 202 are simultaneously arranged in the falling film evaporator.

Figure 10A:
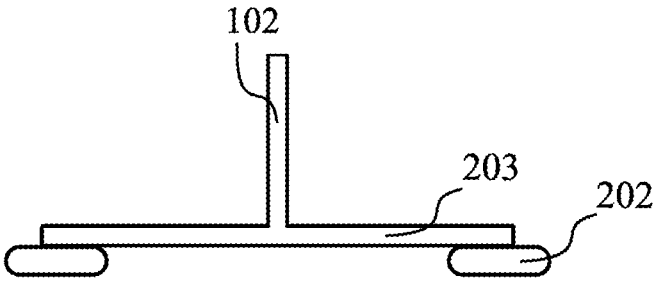
FIG. 10A shows a first embodiment of a structure of two spray tubes in the falling film evaporator.

As shown in FIG. 10A, the two spray tubes 202 are arranged side by side at the same height, and share one liquid entry box 203. The liquid entry box 203 has a wide cross section, so that two side parts in the width direction of the liquid entry box 203 can be connected to top ends of the two spray tubes 202 respectively, and be in communication with the top ends of the two spray tubes 202. In the arrangement just described, fluid communication with the two spray tubes 202 can be achieved simultaneously by means of the shared liquid entry box 203, using one straight-through liquid entry tube 102; thus, the housing 101 need only be provided with one opening for the liquid entry tube 102 to pass through, thereby simplifying the structure of the liquid entry tube 102 and housing 101.

Figure 10B:
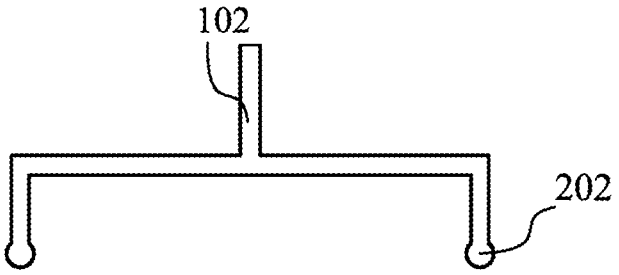
FIG. 10B shows a second embodiment of a structure of two spray tubes in the falling film evaporator.

FIG. 10B shows another embodiment of a double-spray-tube structure. As shown in FIG. 10B, the two spray tubes 202 are arranged in parallel at the same height, and the cross section of each spray tube 202 is substantially round; the round cross section design facilitates uniform scattering of refrigerant in the direction of the spray ports.

Figure 10C:
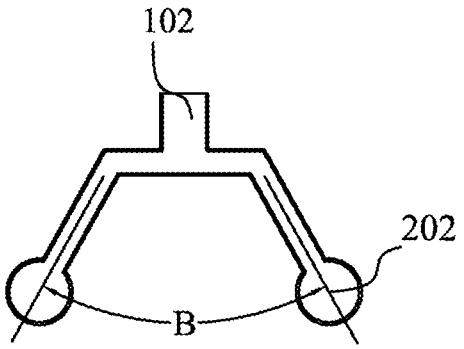
FIG. 10C shows a third embodiment of a structure of two spray tubes in the falling film evaporator.
Figure 10D:
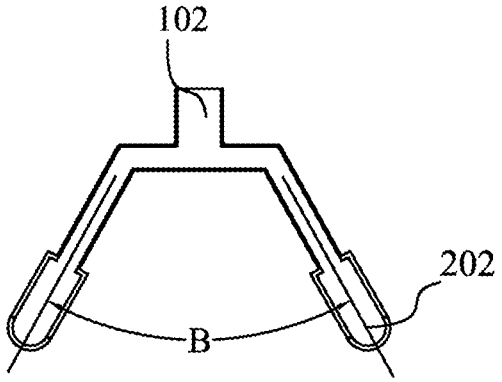
FIG. 10D shows a fourth embodiment of a structure of two spray tubes in the falling film evaporator.

FIGS. 10C and 10D show structures in which the two spray tubes 202 are arranged at a certain angle in the falling film evaporator. As shown in FIGS. 10C and 10D, in the same cross section of the falling film evaporator, the center axes of the two spray tubes 202 form a certain angle B, the angle B being greater than or equal to 60°. This setting of angle B helps to increase the spraying distance of the spray tubes 202 in the falling film evaporator housing in the length direction. In order for the center axes of the two spray tubes 202 in the same cross section of the falling film evaporator to be configured at a certain angle B, the liquid entry tube 102 is configured such that one end thereof is extended vertically downward, and bifurcated into two branch tubes before coming into communication with the spray tubes 202, such that the two branch tubes extend horizontally in opposite directions; above the two spray tubes 202, the two branch tubes form corners, which are obtuse angles, so that the two branch tubes extend obliquely downward away from each other, until they lead into the two spray tubes 202 respectively.

It can be seen from FIGS. 2-10D that in the present application, the length direction of the spray tube 202 is arranged to be perpendicular to the length direction of the housing 101 of the falling film evaporator 100, and the spray ports 301 are in the form of strips, such that the refrigerant sprayed out of the spray tube 202 can flow substantially in the length direction of the housing 101, thereby increasing the movement space of the refrigerant, such that the refrigerant can be uniformly sprayed onto the surface of the perforated plate 205. If the manner of arranging the spray tube 202 in the present application is not employed, the movement path of refrigerant after being sprayed out of the spray tube 202 is highly likely to be restricted due to insufficient radial width of the housing 101, with the result that refrigerant cannot be uniformly sprayed onto the heat exchange tube bundle 201.

Figure 11:
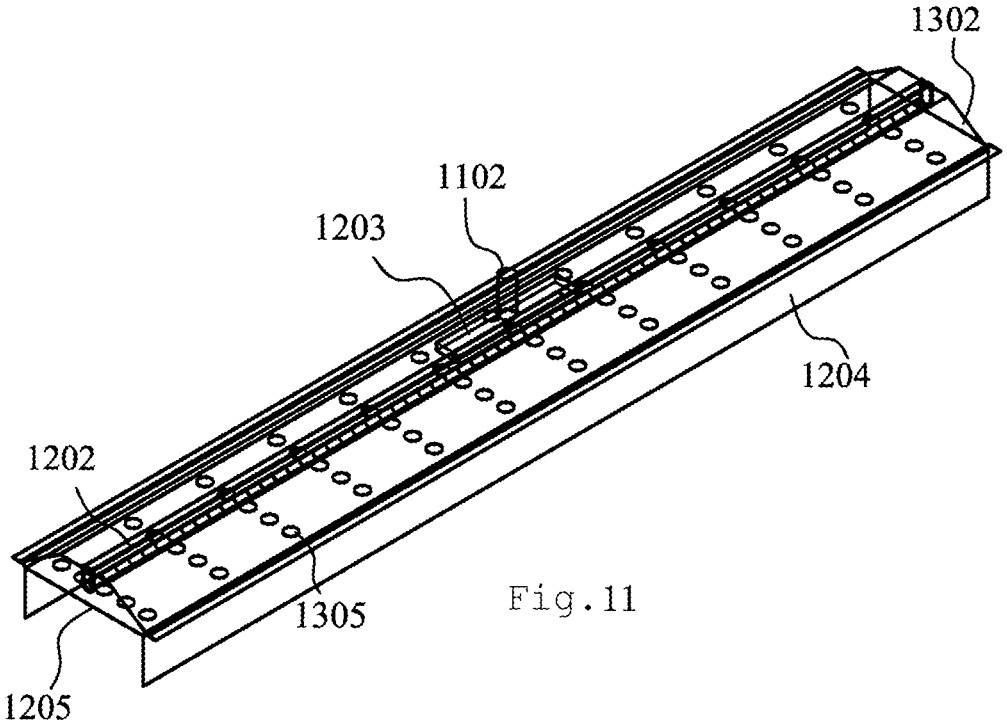
FIG. 11 shows a comparative embodiment of a positional arrangement of a spray tube inside a falling film evaporator.

FIG. 11 shows a comparative example of a positional arrangement of a spray tube 1202 inside a falling film evaporator. Unlike the embodiments of the present application, in which the length direction of the spray tube 202 is arranged to be perpendicular to the length direction of the perforated plate 205, in the comparative example shown in FIG. 11 the length direction of the spray tube 1202 is arranged to be the same as the length direction of the perforated plate 1205. As shown in FIG. 11, the length of the spray tube 1202 is substantially the same as the lengths of a cover plate 1302, a perforated plate 1205 and side stop plates 1204; the spray tube 1202 is arranged above the perforated plate 1205, and a liquid entry tube 1102 and a liquid entry box 1203 are both located above the spray tube 1202. Refrigerant can enter the liquid entry box 1203 from the liquid entry tube 1102, and then be sprayed onto the surface of the perforated plate 1205 by means of the spray tube 1202. The configuration of spray ports 1301 on the spray tube 1202 in the comparative example is the same as the configuration of spray ports 301 shown in FIG. 5 in an embodiment of the present application: multiple spray ports 1301 are parallel to each other and arranged spaced apart at equal distances in the length direction of the spray tube 1202. The difference is that, because the length direction of the spray tube 1202 is arranged to lie in the length direction of the perforated plate 1205 in the comparative example, the abovementioned configuration of the spray ports 1301 causes refrigerant to move substantially in the width direction of the perforated plate 1205 after being sprayed out of the spray tube 1202.

Figure 12:
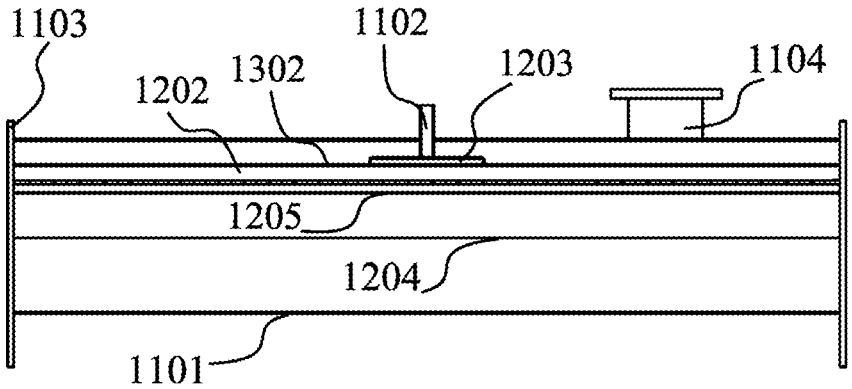
FIG. 12 shows an axial sectional view, at the position of the liquid entry tube, of the falling film evaporator having the positional arrangement of the spray tube shown in FIG. 11.

FIG. 12 shows an axial sectional view, at the position of the liquid entry tube 1102, of the falling film evaporator having the positional arrangement of the spray tube 1202 shown in FIG. 11. As shown in FIG. 12, the liquid entry box 1203, spray tube 1202, cover plate 1302, perforated plate 1205 and side stop plates 1204 are all arranged in the interior of a housing 1101 of the falling film evaporator, and the lengths of the spray tube 1202, cover plate 1302, perforated plate 1205 and side stop plates 1204 are substantially the same as the length of the housing 1101.

Figure 13:
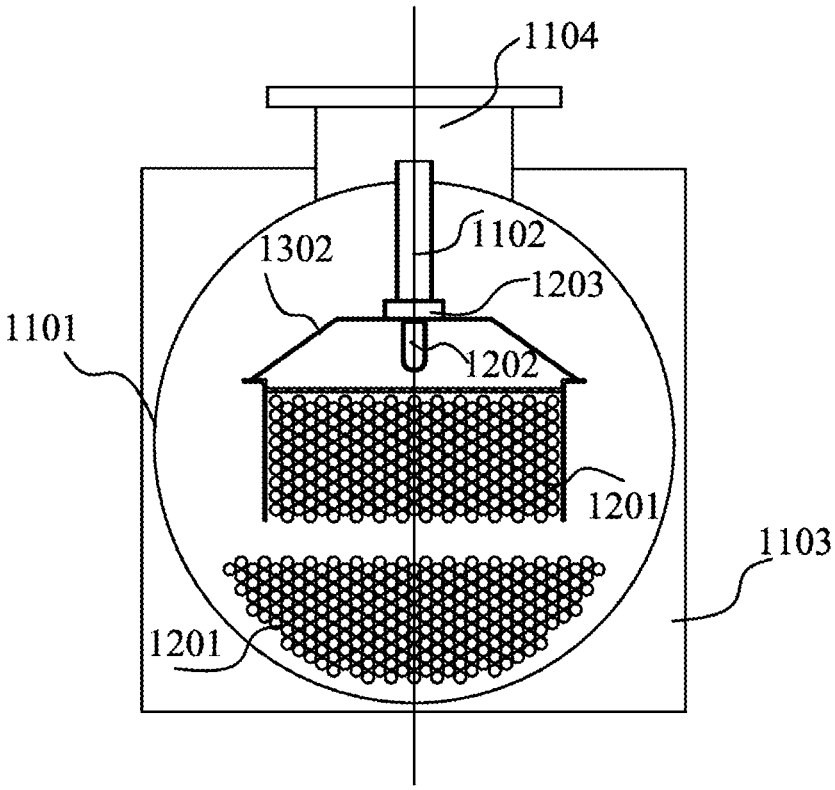
FIG. 13 shows a radial sectional view, at the position of the liquid entry tube, of the falling film evaporator having the positional arrangement of the spray tube shown in FIG. 11.

FIG. 13 shows a radial sectional view, at the position of the liquid entry tube 1102, of the falling film evaporator having the positional arrangement of the spray tube 1202 shown in FIG. 11. As shown in FIG. 13, the left and right sides of the falling film evaporator are arranged symmetrically, wherein the spray tube 1202 is located in a middle position in the width direction of the perforated plate 1205, and two heat exchange tube bundles 1201 are provided below the perforated plate 1205, wherein one heat exchange tube bundle 1201 is accommodated in an accommodating space formed by the perforated plate 1205 and the side stop plates 1204 at two sides thereof, and the other heat exchange tube bundle 1201 is arranged in a bottom space of the housing 1101, with the length direction of each heat exchange tube in the two heat exchange tube bundles 1201 being arranged to lie in the length direction of the housing 1101.

Figure 14:
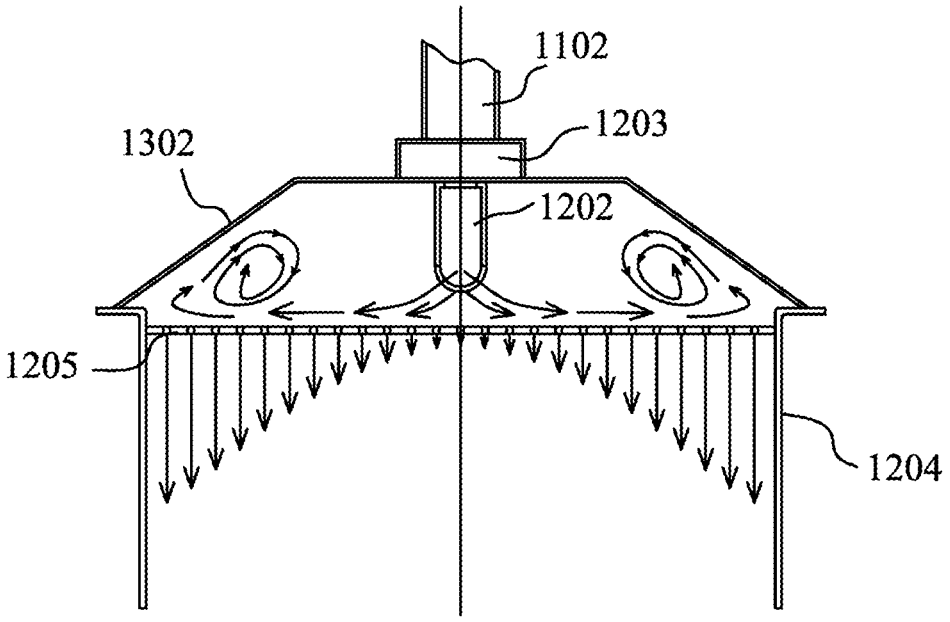
FIG. 14 shows movement paths of refrigerant after being sprayed out of the spray tube shown in FIG. 13.

FIG. 14 shows movement paths of refrigerant after being sprayed out of the spray tube 1202 shown in FIG. 13. As shown in FIG. 14, the refrigerant sprayed out of the spray tube 1202 has a high initial speed, and when it advances to edge parts in the width direction of the perforated plate 1205, the refrigerant still retains a certain transverse speed, but the movement path of the refrigerant is substantially in a radial direction of the housing 1101, and the radial width of the housing 1101 is narrow, restricting the width of the perforated plate 1205, thus the perforated plate 1205 does not have sufficient width for the refrigerant to advance further; the refrigerant having a certain transverse speed develops eddies at the edge parts of the perforated plate 1205 under the blocking action of the cover plate 1302, with the result that a greater amount of refrigerant collects at two sides in the width direction of the perforated plate 1205 than at the middle position.

Figure 15:
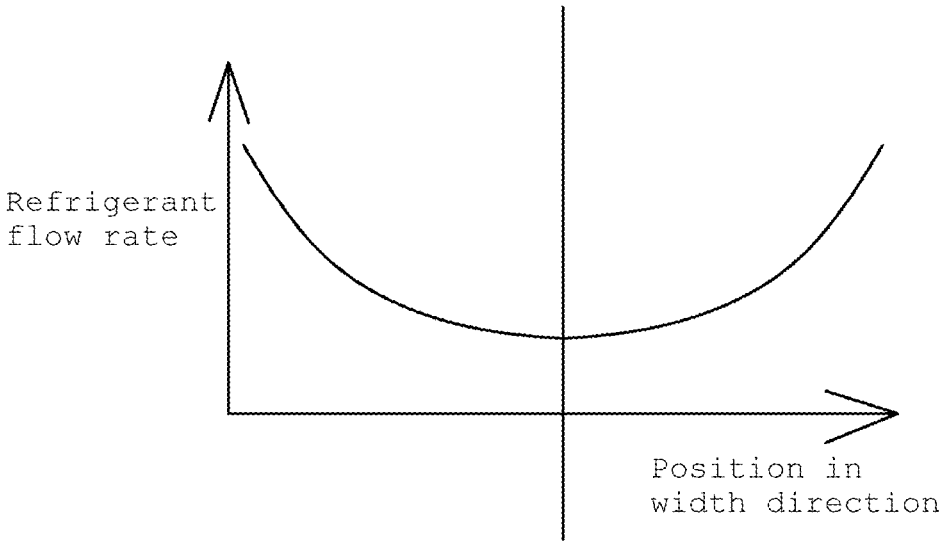
FIG. 15 shows flow rates of refrigerant flowing through different positions in the width direction of the perforated plate shown in FIG. 14.

FIG. 15 shows flow rates of distributed refrigerant flowing through different positions in the width direction of the perforated plate 1205 shown in FIG. 14. The width of the perforated plate 1205 is limited because the radial width of the housing 1101 is narrow; thus, when the length direction of the spray tube 1202 is the same as the length direction of the housing 1101, the refrigerant sprayed out of the spray tube 1202 still has a high transverse speed when it reaches the width edges of the perforated plate 1205, and is therefore restricted in movement, resulting in uneven distribution of refrigerant in the width direction of the perforated plate 1205. As shown in FIG. 15, since the various components in the falling film evaporator are arranged symmetrically at left and right sides in a radial direction thereof, the refrigerant flow rates are also symmetrical in the width direction of the perforated plate 1205 with respect to a center point position thereof. Specifically, the refrigerant flow rate is smallest at a middle position located directly below the spray tube 1202, and as the position is moved toward the two sides in the width direction of the perforated plate 1205, the refrigerant flow rate gradually increases, with the largest refrigerant flow rate at the positions of the two edge parts of the perforated plate 1205.

As can be seen, in the falling film evaporator of the comparative example, the length direction of the spray tube 1202 is configured to lie in the length direction of the housing 1101, such that refrigerant sprayed out of the spray tube 1202 moves substantially in a radial width direction of the housing 1101, and because the radial width of the housing 1101 is narrow, the movement range of the refrigerant after being sprayed out of the spray tube 1202 is greatly restricted, with the result that the refrigerant cannot be uniformly sprayed onto the heat exchange tubes. In the falling film evaporator 100 in an embodiment of the present application, the length direction of the heat exchange tubes 202 is arranged to be perpendicular to the length direction of the housing 101, such that refrigerant sprayed out of the spray tube 202 can move substantially in the length direction of the housing 101, thus increasing the movement path of refrigerant, preventing uneven spraying of refrigerant onto the heat exchange tubes due to movement of the refrigerant being restricted, and thereby avoiding the phenomenon of "dry spots" on the heat exchange tubes caused by uneven spraying of refrigerant. Furthermore, the configuration of the present application described above increases the movement path of refrigerant in the width direction of the spray tube 202, that is to say, the use of the configuration of the spray tube 202 in an embodiment of the present application greatly increases the area of coverage when the perforated plate 205 is sprayed by unit length of the spray tube 202; thus, in order to achieve a spraying effect for a perforated plate of the same area, the use of the configuration of the spray tube 202 in an embodiment of the present application greatly reduces the length of the spray tube 202, and correspondingly, the abovementioned configuration also reduces the number of openings of the spray ports 301 on the spray tube 202, thereby significantly reducing the difficulty and cost of manufacturing the spray tube.

Although the present application is described with reference to the particular embodiments shown in the drawings, it should be understood that the falling film evaporator of the present application can have many variations without departing from the spirit and scope and background of teaching of the present application. Those skilled in the art will also realize that there are different ways of changing structural details in the embodiments disclosed in the present application, all falling within the spirit and scope of this Description and the claims.

The invention claimed is:

1. A falling film evaporator, comprising:

a housing, the housing having an accommodating cavity;

a heat exchange tube, wherein a length direction of the heat exchange tube is the same as a length direction of the housing;

a perforated plate arranged above the heat exchange tube, wherein the perforated plate includes multiple distribution holes;

a spray tube arranged above the perforated plate and including multiple spray ports, the spray tube comprising a first extension part and a second extension part each extending in the length direction of the housing, wherein an end of the first extension part comprises a first outwardly protruding circular-arc end face and an end of the second extension part comprises a second outwardly protruding circular-arc end face, and the multiple spray ports are in the form of multiple strips, wherein at least portions of the multiple strips are arranged on the first outwardly protruding circular-arc end face and the second outwardly protruding circular-arc end face, wherein the multiple spray ports are distributed at intervals in a length direction of the spray tube, and the multiple spray ports are configured to spray a refrigerant toward the perforated plate; and a liquid entry tube in fluid communication with the spray tube, such that the refrigerant flowing through the liquid entry tube can flow into the spray tube;

wherein the heat exchange tube, the perforated plate, and the spray tube are all arranged in the accommodating cavity; and the length direction of the spray tube is substantially perpendicular to the length direction of the housing.

2. The falling film evaporator of claim 1, comprising:

a length direction of the perforated plate that is the same as the length direction of the housing, and configured such that after the refrigerant has been sprayed from the multiple spray ports toward the perforated plate, the refrigerant can flow in the length direction of the perforated plate.

3. The falling film evaporator of claim 1, wherein a cross section of the spray tube comprises a flattened oval shape and the multiple strips are arranged on a portion of the spray tube facing the perforated plate, the first outwardly protruding circular-arc end face, and the second outwardly protruding circular-arc end face.

4. The falling film evaporator of claim 1 wherein a cross section of the spray tube comprises an inverted-"Y" shape with the first extension part and the second extension part separately extending obliquely from the spray tube toward the perforated plate.

5. The falling film evaporator of claim 1, comprising:

multiple spray tubes arranged in the falling film evaporator, wherein inlet ends of the multiple spray tubes are in communication with each other, so that the multiple spray tubes are in fluid communication with each other.

6. The falling film evaporator of claim 5, wherein a number of the multiple spray tubes is an even number, and the multiple spray tubes are distributed symmetrically relative to the liquid entry tube.

7. The falling film evaporator of claim 1, comprising:

a liquid entry box, wherein the liquid entry box is arranged between the liquid entry tube and the spray tube, such that the liquid entry tube and the spray tube can be in fluid communication with each other by means of the liquid entry box.

8. The falling film evaporator of claim 7, comprising:

a cover plate, wherein the cover plate is arranged between the spray tube and the liquid entry box, and a first side edge and a second side edge of the cover plate extend toward the perforated plate and are respectively connected to a first side edge and a second side edge of the perforated plate in a sealed fashion.

9. A system of distributing refrigerant on a heat exchange tube, comprising:

a housing, the housing having an accommodating cavity;

a heat exchange tube, wherein a length direction of the heat exchange tube is the same as a length direction of the housing;

a perforated plate, wherein the perforated plate includes multiple distribution holes and a length direction of the perforated plate is the same as the length direction of the housing;

a spray tube including multiple spray ports, wherein the multiple spray ports are distributed at intervals in a length direction of the spray tube, and the multiple spray ports are configured to spray a refrigerant toward the perforated plate, the perforated plate being positioned between the heat exchange tube and the spray tube;

a liquid entry tube in fluid communication with the spray tube, such that the refrigerant flowing through the liquid entry tube can flow into the spray tube;

a liquid entry box fluidly coupled with the liquid entry tube and the spray tube, such that the liquid entry tube and the spray tube are in fluid communication with each other via the liquid entry box;

a cover plate arranged between the spray tube and the liquid entry box, wherein a first side edge of the cover plate and a second side edge of the cover plate extend toward the perforated plate, the first side edge of the cover plate sealingly connected to a first side edge of the perforated plate and the second side edge of the cover plate sealingly connected to a second side edge of the perforated late; and a gas discharge tube in fluid communication with the housing and configured to discharge gaseous refrigerant from the accommodating cavity;

wherein the heat exchange tube, the perforated plate, and the spray tube are all arranged in the accommodating cavity; and the length direction of the spray tube is substantially perpendicular to the length direction of the perforated plate such that the refrigerant having been sprayed from the multiple spray ports toward the perforated plate can flow in the length direction of the perforated plate.

10. The system of claim 9, comprising multiple spray tubes including the spray tube arranged above the perforated plate, wherein a number of the multiple spray tubes is an even number, and the multiple spray tubes are distributed symmetrically relative to the liquid entry tube, and wherein inlet ends of the multiple spray tubes are in fluid communication with each other by means of the liquid entry box.

11. The system of claim 10, comprising a surface of each of the multiple spray tubes having a circular-arc end face protruding in the direction of the perforated plate, wherein the multiple spray ports are in the form of multiple strips, and at least a portion of the multiple strips are arranged on the circular-arc end face.

12. A falling film evaporator, comprising:

a housing having an accommodating cavity;

a heat exchange tube disposed in the accommodating cavity, wherein a length direction of the heat exchange tube is the same as a length direction of the housing;

a perforated plate disposed in the accommodating cavity and arranged between the heat exchange tube and a spray tube, wherein the perforated plate includes multiple distribution holes and a length direction of the perforated plate is the same as the length direction of the housing;

the spray tube disposed in the accommodating cavity and including multiple spray ports, the spray tube including a circular-arc end face protruding in the direction of the perforated plate, wherein the multiple spray ports are in the form of multiple strips and distributed at intervals in a length direction of the spray tube, and at least a portion of the multiple strips are arranged on the circular-arc end face, and wherein the multiple spray ports are configured to spray a refrigerant toward the perforated plate; and a liquid entry tube in fluid communication with the spray tube, such that the refrigerant flowing through the liquid entry tube can flow into the spray tube, wherein the length direction of the spray tube is substantially perpendicular to the length direction of the perforated plate such that the refrigerant having been sprayed toward the perforated plate from the multiple spray ports can flow in the length direction of the perforated plate, wherein the liquid entry tube bifurcates into a first path and a second path that each extend in the length direction of the housing and towards the perforated plate; and a first spray tube is disposed at the end of the first path of the liquid entry tube and a second spray tube is disposed at the end of the second path of the liquid entry tube, wherein a center axes of the first spray tube and a center axes of the second spray tube form an angle greater than or equal to sixty degrees.

13. The falling film evaporator of claim 12, wherein a cross section of the spray tube has a flattened oval shape with a first extension part and a second extension part extending away from one another, wherein the first extension part and the second extension part each comprises outwardly protruding circular-arc end faces, and the multiple spray ports are in the form of the multiple strips, wherein the multiple strips are arranged on a surface of the spray tube facing the perforated plate and on at least a portion of the circular-arc end faces.

14. The falling film evaporator of claim 12, wherein a cross section of the spray tube has an inverted-"Y" shape with a first extension part and a second extension part separately located on a surface of the spray tube facing the perforated plate and extending obliquely toward the perforated plate, wherein the first extension part and the second extension part each comprises outwardly protruding circular-arc end faces, and the multiple spray ports are in the form of the multiple strips, wherein the multiple strips are arranged on the circular-arc end faces.

* * * * *